US008485013B2

(12) United States Patent
Hossler et al.

(10) Patent No.: US 8,485,013 B2
(45) Date of Patent: Jul. 16, 2013

(54) METHOD AND TOOLING FOR HEADED PILOT POINTED BOLTS

(75) Inventors: Todd Hossler, Tiffin, OH (US); Stanley J. Wasserman, Tiffin, OH (US)

(73) Assignee: National Machinery LLC, Tiffin, OH (US)

( * ) Notice: Subject to any disclaimer, the term of this patent is extended or adjusted under 35 U.S.C. 154(b) by 1240 days.

(21) Appl. No.: 12/056,382

(22) Filed: Mar. 27, 2008

(65) Prior Publication Data

US 2009/0247310 A1 Oct. 1, 2009

(51) Int. Cl.

| | |
|---|---|
| ***B21D 22/00*** | (2006.01) |
| ***B21J 13/00*** | (2006.01) |
| ***B21J 13/02*** | (2006.01) |
| ***B21H 3/02*** | (2006.01) |

(52) U.S. Cl.
USPC ..... 72/356; 72/446; 470/11; 470/139

(58) Field of Classification Search
USPC ..... 72/352, 354.6, 354.8, 355.2, 353.2, 72/353.4, 353.6, 356, 465.1, 468, 472; 470/8, 470/11, 57, 58, 63–65, 86, 16, 139, 191
See application file for complete search history.

(56) References Cited

U.S. PATENT DOCUMENTS

| | | | | |
|---|---|---|---|---|
| 5,619,882 | A * | 4/1997 | Godtner | 72/356 |
| 5,657,663 | A | 8/1997 | Miyahara et al. | |
| 5,704,245 | A * | 1/1998 | McClellan et al. | 72/446 |

FOREIGN PATENT DOCUMENTS

| | | | |
|---|---|---|---|
| JP | 56-111540 | A | 9/1981 |
| JP | 05-078335 | U | 10/1993 |
| JP | 08-192241 | A | 7/1996 |
| JP | 2000-061575 | A | 2/2000 |

OTHER PUBLICATIONS

Written Opinion of the International Searching Authority and International Search Report dated Nov. 12, 2009 of International PCT Application No. PCT/US2009/038331, filed Mar. 26, 2009.

* cited by examiner

*Primary Examiner* — Debra Sullivan
(74) *Attorney, Agent, or Firm* — Pearne & Gordon LLP

(57) ABSTRACT

A set of tooling for making pointed headed bolts of a given diameter in numerous lengths with roll thread ready threaded to the head and partially threaded shanks in a four forming station forming machine, the tools being configured to work on wire stock as received at the first station of a diameter larger than or substantially the same as the roll diameter and not greater than the nominal diameter of the bolt, including at least two sequential head forming tools for mounting on the slide, an extrusion pointing tool for mounting on the die breast, a roll diameter extrusion tool for mounting on the die breast and a head support tool mountable in a station on the slide at multiple axial positions corresponding to standard lengths of the bolts being made, the head support tool being arranged to work at either the extrusion pointing station or the roll diameter extrusion station.

7 Claims, 9 Drawing Sheets

FIG. 7
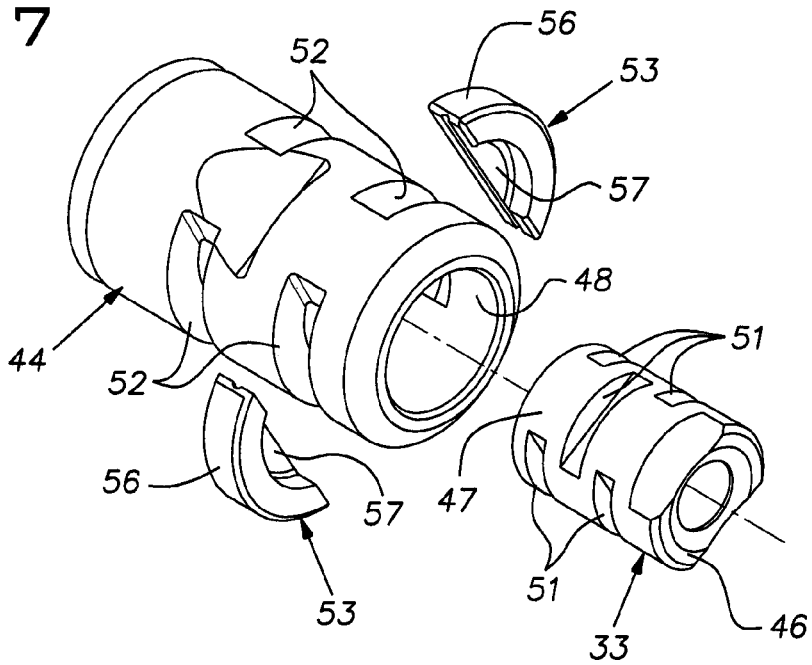
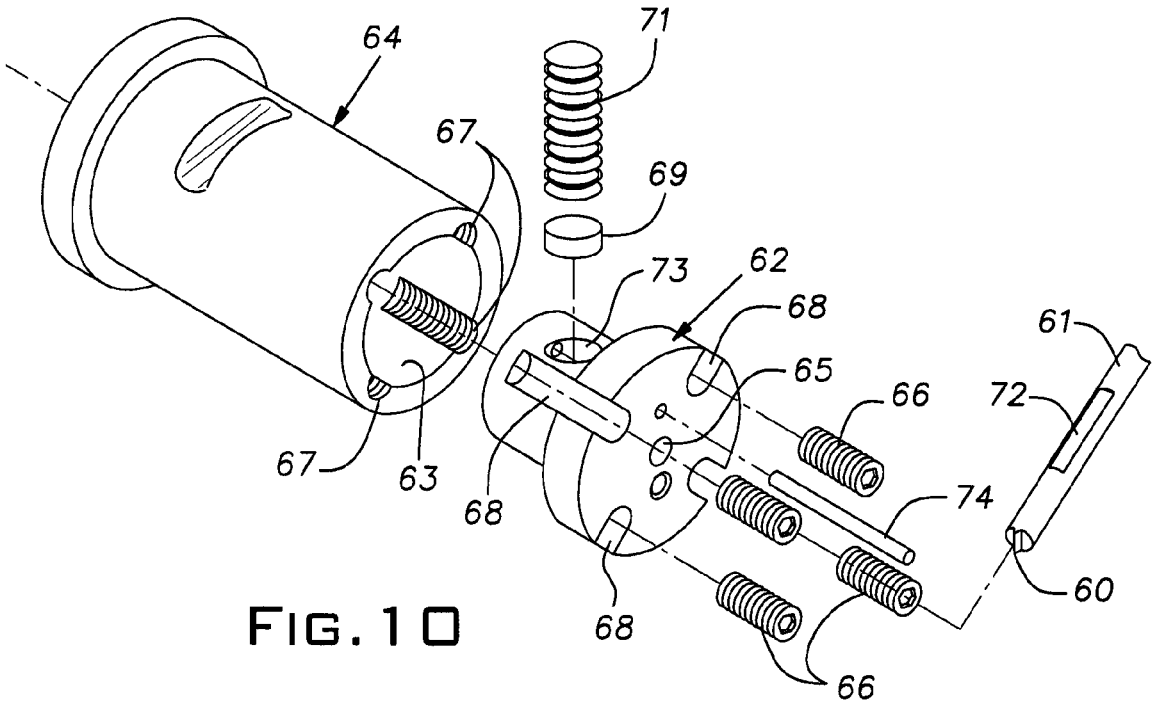
FIG. 10

METHOD AND TOOLING FOR HEADED PILOT POINTED BOLTS

BACKGROUND OF THE INVENTION

The invention relates to cold-formed machine bolts and, in particular, methods and tooling for economically producing such machine bolts.

PRIOR ART

Machine bolts are commonly made by producing a headed blank or preform in a progressive cold-forming or forging machine and, thereafter, rolling a thread on the shank of the blank. Typically, the shank end of the blank is chamfered so that when finished, the threaded bolt has a "point", albeit blunt, that enables it to be self-centering with a threaded hole and thereby facilitate its final assembly.

Conventionally, the cold-forming process can involve five progressive forming stations. Typically, the tooling for shaping at least the shank part of the blanks is dependent on the length of a bolt. Thus, the prior art number of forming stations and the use of length specific tooling makes the tooling for a full range of bolt lengths relatively expensive for a bolt manufacturer. Consequently, to limit tooling costs, it is not unusual for a manufacturer to produce only a limited number of bolt lengths for a given bolt size (diameter). As a result, the manufacturer may not achieve the greatest economy and a bolt distributor or high volume user may have to depend on more than one manufacturer to supply its needs. Frequently, the cold-forming tooling available to a manufacturer may be incapable of pointing the blank so that a second machining operation is required and attendant material, machine time and labor costs are incurred.

SUMMARY OF THE INVENTION

The invention provides an exceptionally versatile tooling package for progressive forming machines capable of producing blanks for a full range of bolt lengths, all pointed, in four die stations. The number of tools or dies is greatly reduced compared to prior art practices, and can be applied to a four station header to produce a full range of pointed bolt lengths. This feat, which greatly reduces the number of tools, is accomplished in part by use of different fillers and/or a multi-position blank head supporting sleeve to axially position a tool or tools each at an appropriate one of multiple locations and thereby account for different blank lengths. More specifically, a complete set of forming tools can comprise a progressive series of cavities for forming and supporting the blank head and groups of tools for shaping the shanks of threaded to the head blanks or blanks with partially threaded shanks.

The ability to use a four station machine, as afforded by the invention, rather than a five station machine, represents a significant reduction in tooling. Moreover, the disclosed methodology permits the use of some of the same tools to make hex flange bolts, hex head bolts, and socket head cap screws, thereby affording significant additional savings in tooling costs.

BRIEF DESCRIPTION OF THE DRAWINGS

FIG. 7 is an exploded perspective view of a multi-position bolt head supporting sleeve and associated case and keys of the invention;

FIG. 10 is an exploded perspective view of a hard plate and case assembly constructed in accordance with the invention.

DESCRIPTION OF THE PREFERRED EMBODIMENTS

A cold forging machine 10 of generally conventional construction is represented by a die breast 11 and a slide 12 in FIGS. 1-5. The illustrated machine 10 has and the disclosed bolt forming processes uses four part forming or work stations 13-16. In FIGS. 1-5, the slide or ram 12 is shown in its forwardmost position where the opposed faces of the punch and die cases can be as close as 1 mm.

As mentioned above and explained in greater detail below, the invention offers a methodology for forming several popular styles of bolts in standard lengths, pointed and ready to be roll threaded, with a greatly reduced number of tools compared to that of previously used conventional methods. It will be understood that the tooling and process disclosed herein produce pointed bolt preforms or blanks that are subsequently finished in thread rolling dies, known in the art. These bolt preforms or blanks, as is customary in the industry, are sometimes simply called bolts herein, and this term is likewise applied herein to the parts being progressively formed.

Figure 1:
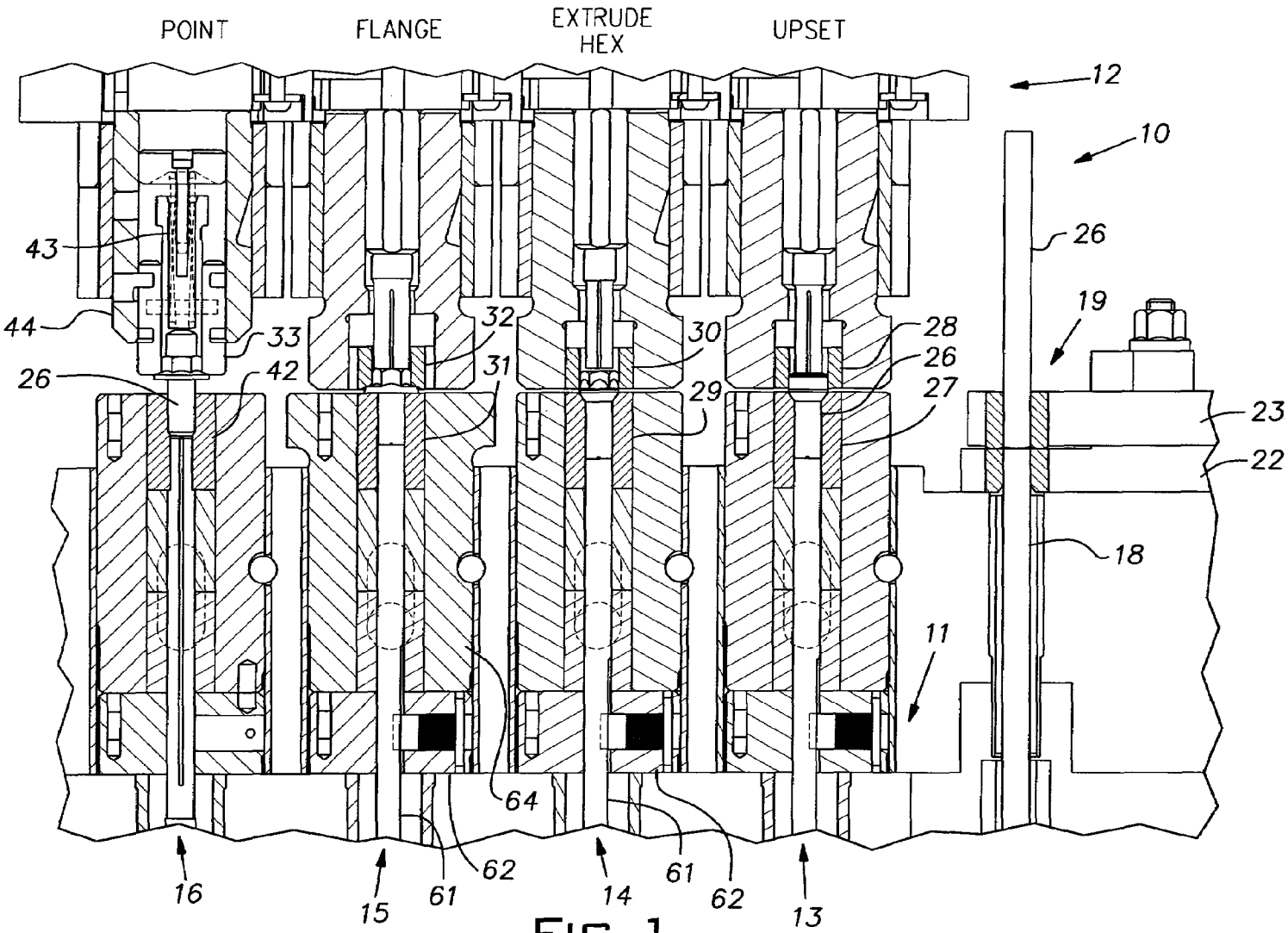
FIG. 1 is a cross-sectional view taken in a horizontal plane of a four station progressive cold-forging machine set up to make short threaded to the head hex flange bolts.

In the following written disclosure and drawings, like parts are identified with the same numerals. With reference to FIG. 1, the machine 10 receives wire stock 18 at a cut off station 19 where, during each cycle of the slide 12, a precise length of material 26, hereinafter referred to as a bolt, is severed by a pair of shear plates 22, 23. A transfer of known design moves the bolt 26 from the cut off station 19 to the successive work stations 13-16, each time the slide 12 reciprocates.

FIG. 1 illustrates the progressive formation of pointed and eventually threaded to the head hex flange head bolts that, when rolled with a thread, can conform to the European standard DIN EN 1662, for example. When a bolt is removed from the last station in any of the bolt types disclosed herein, it will be finish headed, pointed, and ready for roll threading on a roll diameter on its shank.

When the slide or ram 12 is retracted from its illustrated position, the bolt 26 is transferred to the first station 13, it being understood that any preceding bolts in the first and subsequent stations 14-16 are simultaneously indexed or transferred to the next station and eventually discharged after forming in the fourth or last station 16.

The bolt 26, in the sequence depicted in FIG. 1, has its shank portion received in a die or insert tool 27 on the die breast 11 and its head portion initially upset in an insert tool 28 on the slide 12 at the first station 13. The diameter of the wire supplied to the cut off station 19 is substantially equal to, i.e. slightly smaller, e.g. a few thousandths of an inch, than the ideal or nominal roll or pitch diameter of a finished shank to account for any incidental growth in diameter in the first station 13 and subsequent stations 14-16. The nominal roll diameter at the first station 13 and subsequent stations 14-16 exists along the full length of the shank so that the part can be of the threaded to the head style of fastener.

Figure 8:
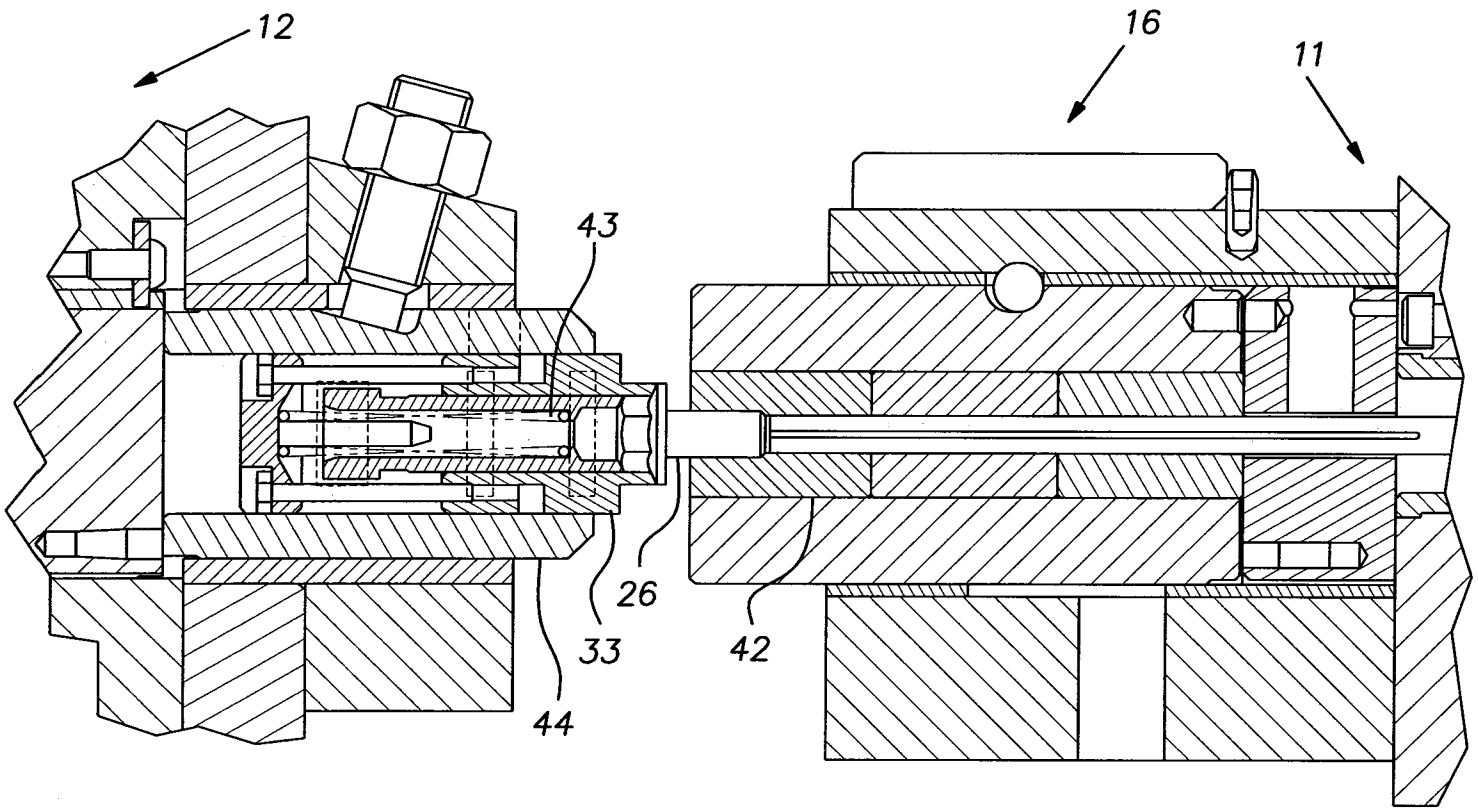
FIG. 8 is a fragmentary cross-sectional view of the fourth station of the machine depicted in FIG. 1, taken in a vertical plane, set up for pointing relatively short, threaded to the head hex flange head bolts.

The bolt 26 is transferred to the second work station 14 during the next machine cycle. Here, a hex shape is extruded on the head of the bolt 26 by a pair of tools 29, 30 on the die breast 11 and slide 12, respectively. Next, the bolt 26 is transferred to the third station 15 where a flange is formed between die and punch tools 31, 32. Thereafter, the bolt 26 is transferred to the fourth or last forming station 16 where the flanged head is supported in a sleeve 33 on the slide 12 and the distal end of the shank is pointed in an extrusion die 42. A spring assembly 43 is disposed in the sleeve 33 and is effective in temporarily supporting the bolt 26 to facilitate transferring action. FIG. 8 illustrates the forth station 16 in a vertical cross-section on a somewhat enlarged scale over FIG. 1.

FIG. 7 illustrates the sleeve 33 in exploded relation to a case 44 in which it is selectively axially positioned in accordance with the length of bolt 26 being produced. A forward face or surface 46 of the sleeve 33 supports the head of the bolt 26 during the pointing or forming step at the fourth station 16 depicted in FIG. 1. Both the sleeve 33 and case 44 are generally cylindrical tubular bodies. An outside diameter or surface 47 of the sleeve 33 is proportioned with a close fit to a bore 48 of the case 44. The exterior 47 of the sleeve 33 is cut with pairs of opposed chordal slots 51. The case 44 is similarly cut with pairs of opposed chordal slots 52 that extend through the wall of the case.

Figure 3:
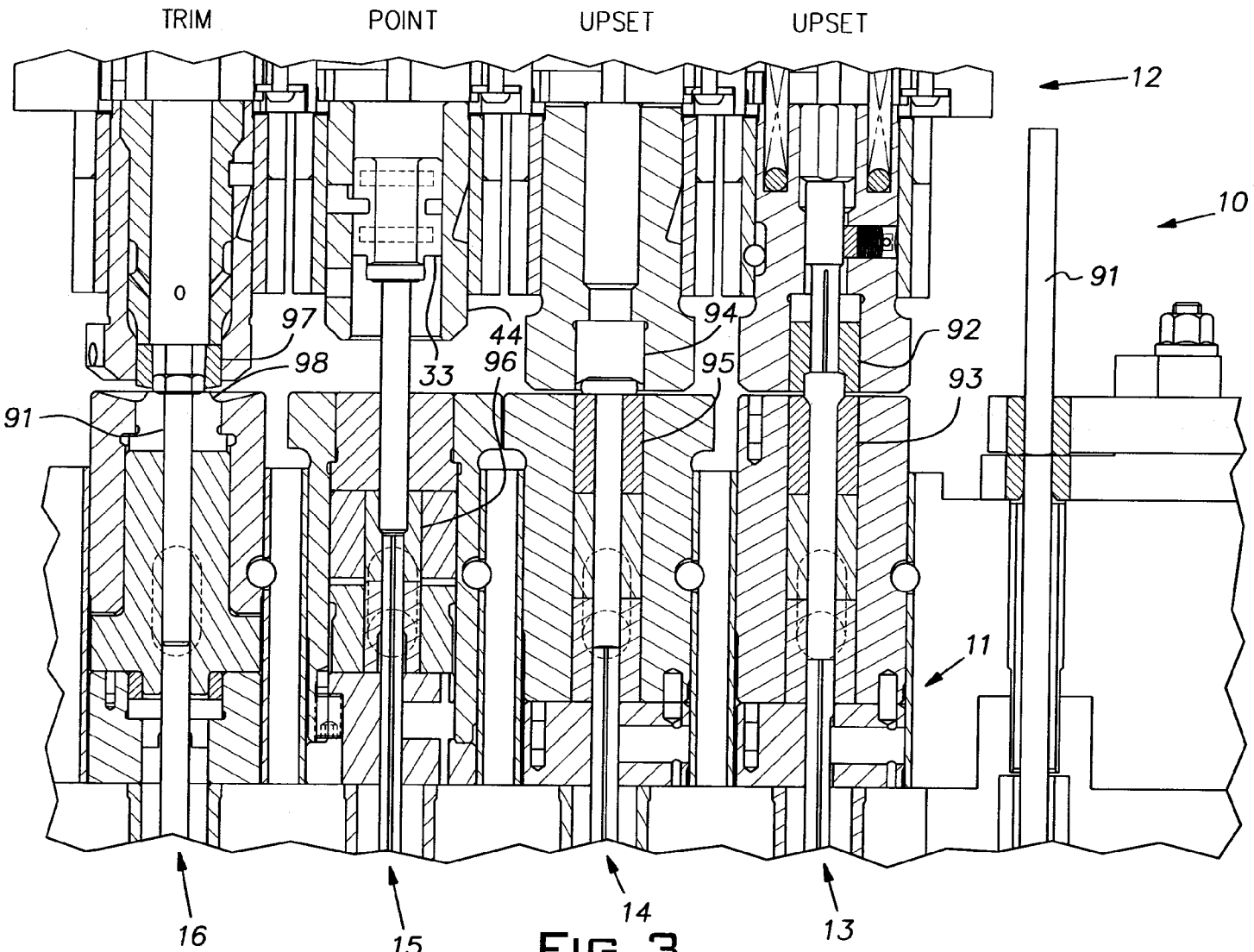
FIG. 3 is a is a cross-sectional view taken in a horizontal plane of a four station progressive cold-forging machine set up to make full thread hex head bolts.
Figure 4:
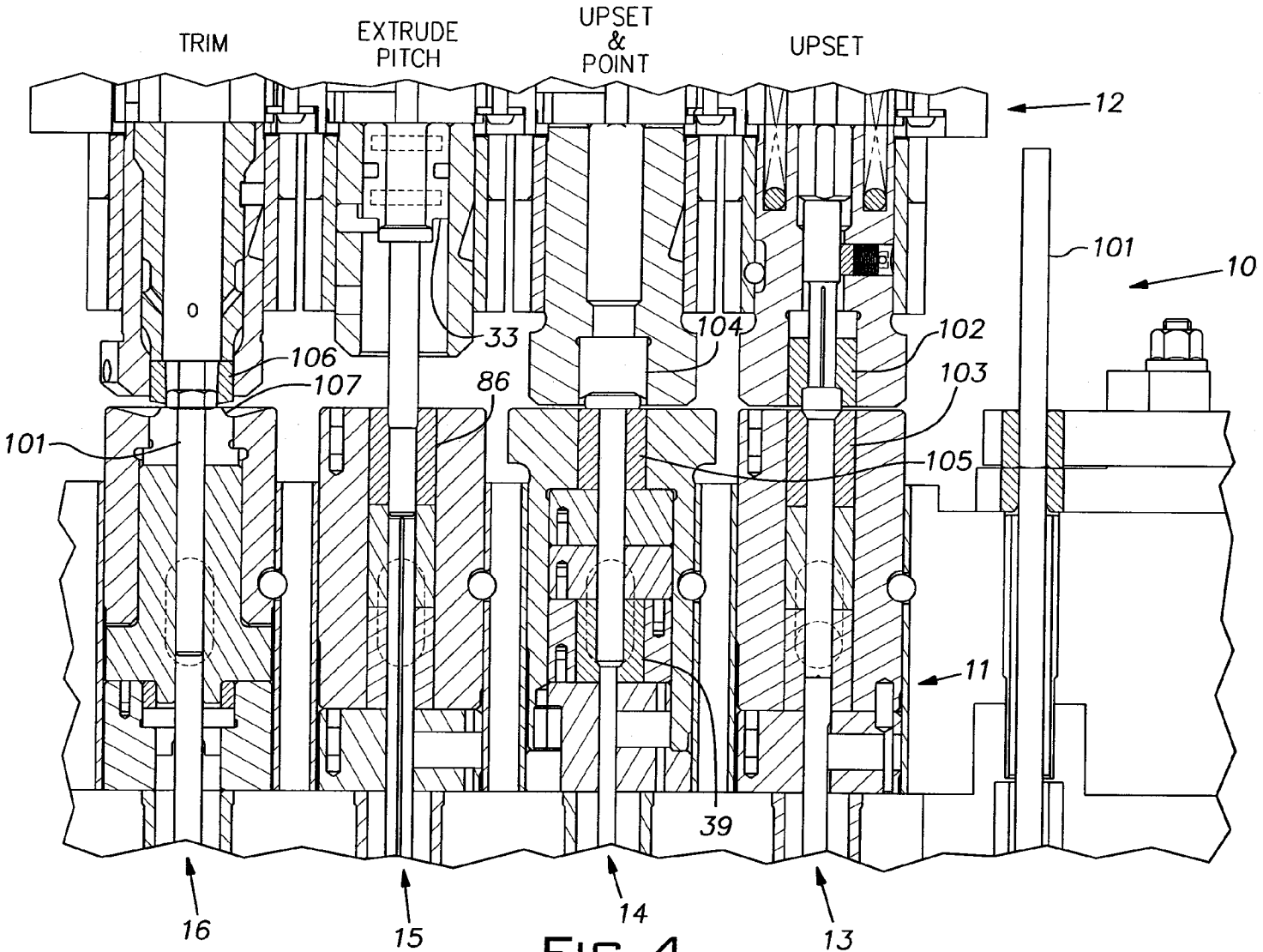
FIG. 4 is a cross-sectional view taken in a horizontal plane of a four station progressive cold-forging machine set up to make partially threaded hex head bolts.

The axial position of the sleeve 33 in the case 44 is fixed by a pair of identical keys 53 having chordal profiles. Outer circular or peripheral areas 56 of the keys 53 have a radius that is essentially the same as the radius of the outer surface of the cylindrical case 44. The axial dimension of the major thickness of the keys 53 provides a close fit with the axial length or width of the case slots 52. At their central area, the keys 53 have chordal webs 57 of an axial thickness half that of the outer or major parts of the keys and are sized to closely fit into the slots or notches 51 in the sleeve 33. Preferably, the axial dimensions of the key webs 57, key periphery 56, sleeve slots 51, sleeve slot axial spacings, case slots 52, and case slot spacings are all units or multiples of the increments that the standard bolts differ in length, e.g. 2, 4, or 5 mm. When tooling is set up to make a particular bolt length, the sleeve 33 is positioned in the case 44 at a desired location, the keys 53 are placed in whichever sleeve and case slots 51, 52 line up (on each side of the case) and this sleeve, case, and key assembly is slipped into the sleeve of the respective work station 16 (FIGS. 1 and 5) or 15 (FIGS. 3 and 4). By properly setting the sleeve 33 in the case 44, standard length threaded to the head bolts can be produced using the same pointing die 42.

A bolt with a head having a hex shape or otherwise non-circular form should not rotate when being transferred from one station to another, so that the head will be angularly registered with the tools at the succeeding station. The risk of unwanted rotation, in accordance with the invention, is reduced by locking the part against such rotation, while it is being picked up by the transfer fingers, with a formation of a small diametral chisel edge or projection 60 on the end face of knockout pins 61 in the relevant work stations. At various stations, a knockout pin 61 lies at the center line of a work station. Typically, the knockout pin extends through a bore 65 in hard plate 62 mounted on the die breast 11 and backing up or axially supporting the tooling against forming loads at the respective die station. With reference to FIG. 10, the angular orientation or position of the hard plate 62 in a cylindrical bore 63 of a circular case 64 is maintained, in accordance with the invention, by headless set screws 66 received in axially oriented, threaded, semi-circular slots 67 in quadrature on its periphery and open to the bore 63. The hard plate 62 has a complementary set of axially extending semi-circular slots 68 arranged, in quadrature, on its periphery to register with and complement the slots 67 in the bore 63. The associated knockout pin 61 and, therefore, its chisel end face is maintained in a proper orientation with reference to the hard plate 62 by a shoe 69 biased by bevel springs 71 against an elongated flat 72 on a side of the knockout pin. The springs 71 and shoe 69 are retained in a radial bore 73 in the hard plate 62 by an axially oriented pin 74. The shoe 69, bearing against the flat 72, allows the pin 61 to reciprocate but prevents rotation of the pin about its longitudinal axis.

Figure 2:
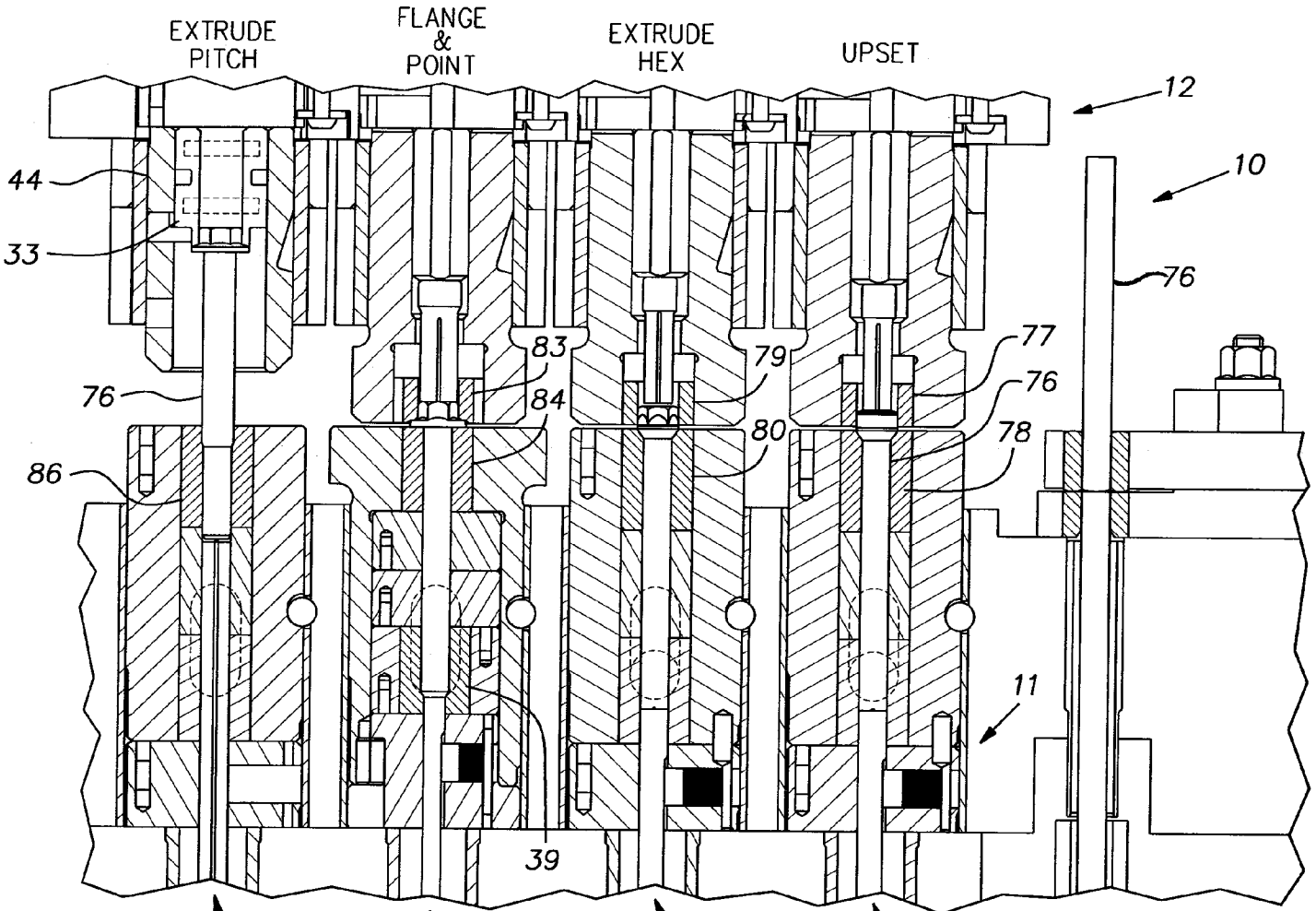
FIG. 2 is a cross-sectional view taken in a horizontal plane of a four station progressive cold-forging machine set up to make long partially threaded hex flange bolts.

FIG. 2 illustrates the inventive process and tooling as applied to producing standard hex flange bolts, again under the European standard DIN EN 1662 where the standard lengths are greater than the standard threaded to the head lengths as discussed with respect to FIG. 1 above. Machine elements or parts that are the same or similar to that described in connection with FIG. 1 are identified with the same numerals here in FIG. 2 and, below, with reference to FIGS. 3 through 5, and certain other figures. The sequence of transferring bolts discussed in reference to FIG. 1, similarly, is the same for the tooling set ups in FIGS. 2 through 5. The bolt 76 begins successive heading, pointing, and roll diameter formation at the first work station 13 where it is upset to partially form the head with punch and die tools 77, and 78. At the second forming station 14, a hex shape is extruded on the head by cooperating tools 79, 80 on the slide 12 and die breast 11, respectively. In the third work station 15, opposed tools 83 and 84 form the flange of the head in an upset action, and a tool or die insert 39 in a limited extrusion like action forms a point on the distal end of the bolt shank.

Figure 9:
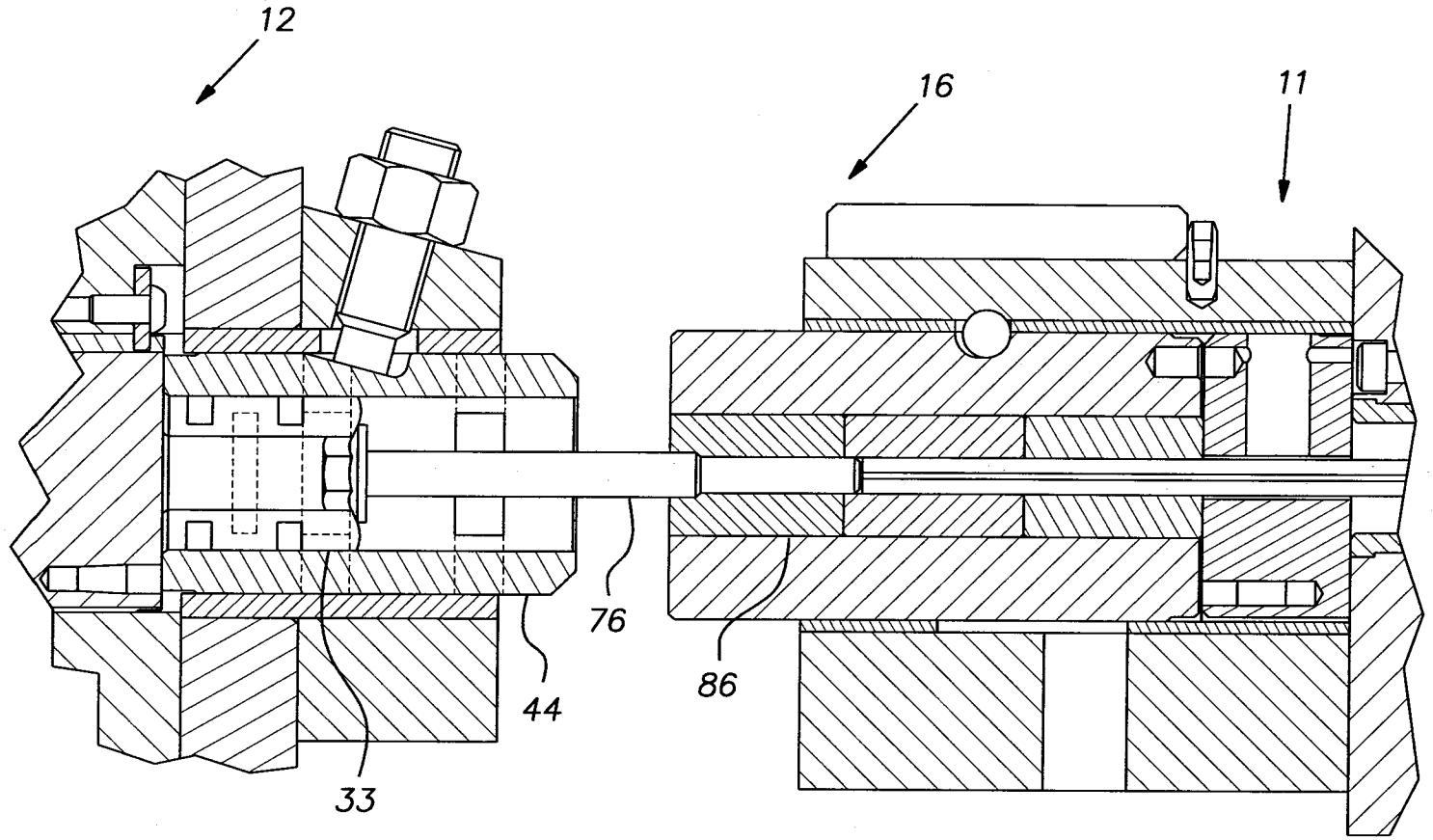
FIG. 9 is a view similar to FIG. 8 showing a set up for extruding the roll diameter of relatively long partially threaded hex flange head bolts.

At the fourth station 16 also depicted in a vertical cross-section in FIG. 9, the distal end of the bolt shank is extruded in a die insert or tool 86 reducing its diameter to that of a roll diameter along a length corresponding to a standard thread length. The head of the bolt 76 at this station 16 is axially supported and driven by the sleeve 33 described above in connection with FIG. 7. In the set-up of FIG. 2, the sleeve 33 is held by the keys 53 towards the rear of the case 44 such that the head and a significant portion of the shank is received in the case. The stepwise multiple positions of the sleeve, similar to its use in the process described in connection with FIG. 1, allows a single die insert 86 to be used to extrude the roll diameter on a plurality of lengths and preferably the full range of standard lengths of partially threaded bolts.

Returning to the discussion of the process at the third station 15, differences in the lengths of bolts in a standard range are, in accordance with the invention, accounted for by axially shifting a pointing tool or insert in its respective case and/or substituting another insert with an incrementally different axial location of the pointing area or throat in the insert, the differences in location corresponding to differences in standard bolt lengths. FIGS. 6*a-i*, illustrate these variations, the numerals 37, 38, 39 and 40 identifying different inserts. The elements 34 are fillers of equal length.

FIG. 3 illustrates the inventive process and tooling applied to making threaded to the head hex head screws or bolts such as conforming to European Standard DIN EN ISO 4017. Like the process shown in FIG. 1, wire stock fed to the cut off station 19 is slightly less than the nominal roll diameter of the finished blank. At the first station 13, a bolt 91, with this near a roll diameter along substantially the full length of its shank, has its head initially coned or upset in punch and die tools 92, 93, respectively. At the second station 14, the head is further upset between punch and die tools 94, 95. The bolt 91 is pointed in an extrusion like process in a die 96 on the die breast 11 at the third station 15. Differences in the lengths of hex head bolts are accounted for by the multiple position sleeve 33, optionally having its face modified to conform to the intermediate head profile of the bolt 91 at this station 15 with the case 44 and keys 53 as disclosed in connection with the set up of FIG. 1. Additionally, the die or insert 96 can be double ended and reversed end for end to change the axial location of the operative extrusion like pointing throat and thereby supplement the range of position adjustment offered by the sleeve 33 carried on the slide 12. The cross section of the head of the bolt 91 preferably produced in the first two stations 13, 14, is generally circular. In the fourth station 16, the head of the bolt 91 is trimmed into a hex between opposed tools 97, 98.

Referring to FIG. 4, conventional partially threaded hex head pointed bolts are made with the inventive process and tooling. Such bolts can conform to the DIN EN ISO 4014 standard. The head of a bolt 101 is initially headed or coned at the first station 13 between tools 102, 103. At the second station 14, the head is further upset by tools 104, 105 and the distal end of the shank is pointed by an extrusion like tool 39. The specific length of the bolt 101 is accounted for by using the dies, fillers, and techniques described in connection with FIGS. 2 and 6 with reference to the set up at the third station of FIG. 2. The roll diameter of the bolt 101 is extruded on the shank at the third station 15 in a tool or insert 86 which can be the same tool as used in the set up of FIG. 2 at the fourth station 16. Variations in the length of the bolt 101 can be accommodated by the multi-position sleeve 33 as explained above. The head of the bolt 101 is trimmed to a hex shape at the fourth station by tools 106, 107.

Figure 5:
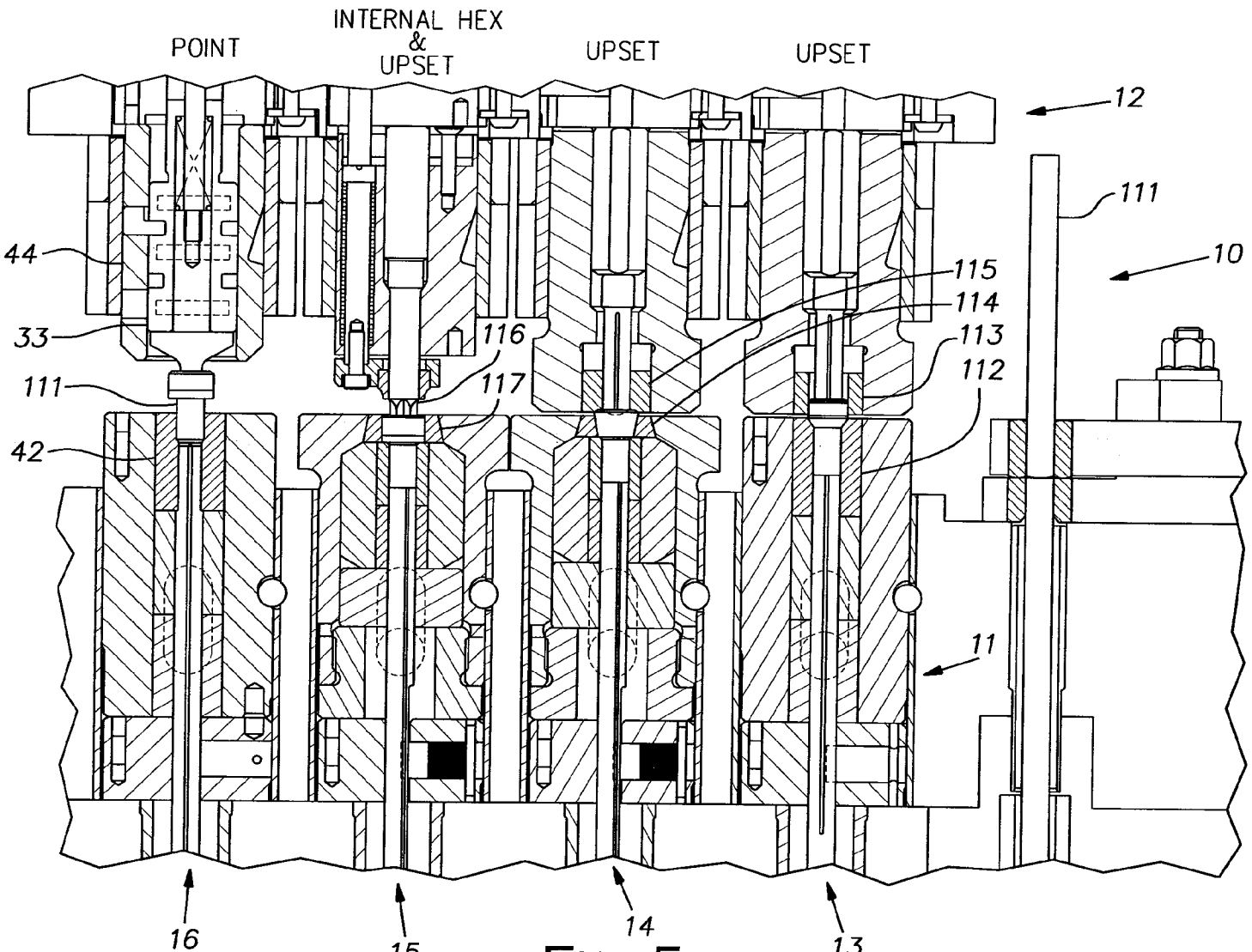
FIG. 5 is a cross-sectional view taken in a horizontal plane of a four station progressive cold-forging machine set up to make short threaded to the head socket head cap screws.
Figure 6A:
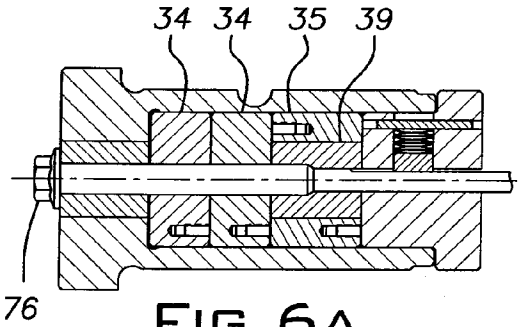
FIGS. 6*a-i* are a series of partial sections of the third station of the forging machine set up to point blanks of different lengths in the process shown in FIG. 2.
Figure 6B:
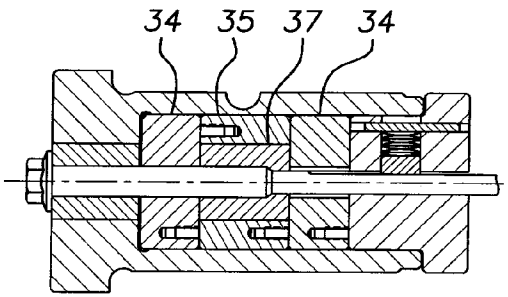
Figure 6C:
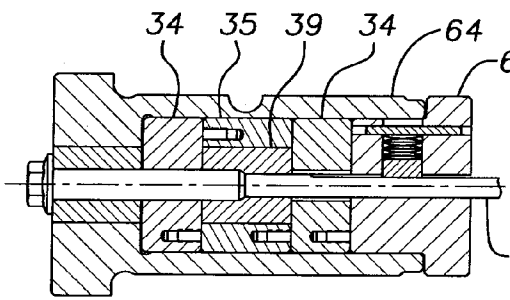
Figure 6D:
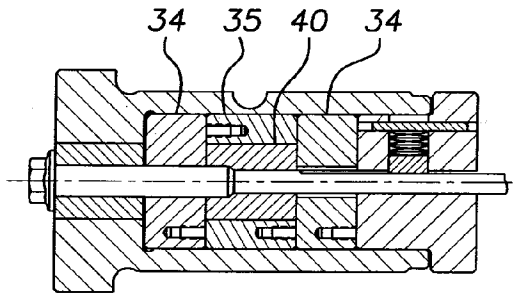
Figure 6E:
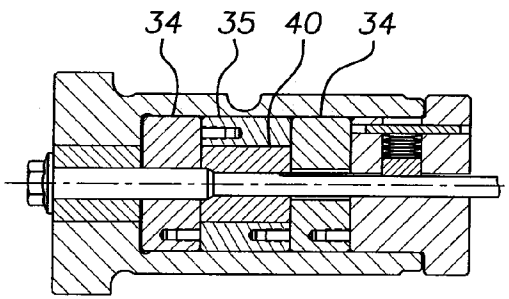
Figure 6F:
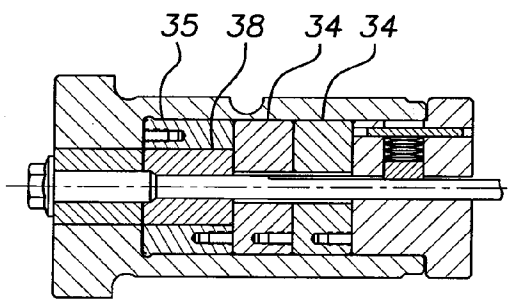
Figure 6G:
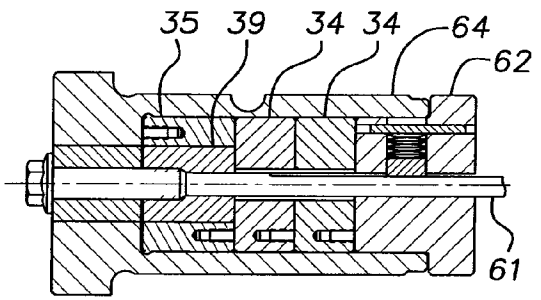
Figure 6H:
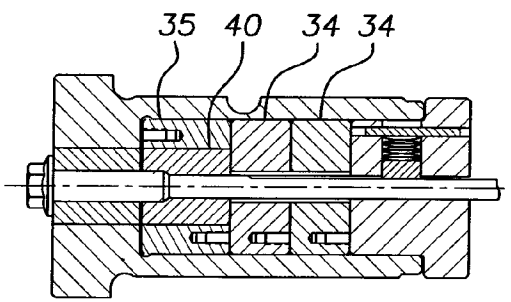
Figure 6I:
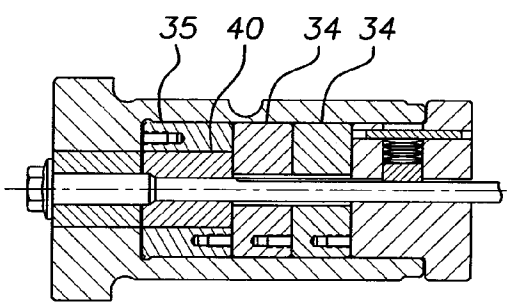

FIG. 5 illustrates the method and tooling by which the invention produces threaded to the head socket head cap screws 111 such as specified in the DIN EN ISO 4762 standard. Again, like the processes shown in FIGS. 1 and 3, wire stock fed to the cut off station 19 is slightly less than the nominal roll diameter of the finished blank to account for incidental growth in diameter at the work stations 12-16. The bolt 111 with the near roll diameter along its shank has its head initially upset in the first station 13 in die and punch tools 112, 113. At the second station 14, the bolt 111 is progressively formed by further upsetting the head in tools 114, 115. At the third station 15, the bolt head is fully upset and formed with an internal hexagonal blind hole with punch and die tools 116, 117. At the last station 16, the part is forced into a die tool the same as or like the tool 42 used on the last die station illustrated in FIG. 1. As in FIG. 1, the sleeve 33 or an equivalent thereof can be appropriately positioned in the case 44 on the slide in the last station 16 to account for differences in the lengths of the bolts 111 being produced.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A set of tooling for making pointed, headed preform bolts of a given diameter in numerous lengths with roll thread ready threaded to head and roll thread ready partially threaded shanks in a four forming station forging machine, the tools being configured to work at successive forming stations on wire stock which is received at a first forming station of a diameter larger than the roll diameter or a diameter substantially equal to a roll diameter and not greater than a nominal diameter of a bolt, including at least two sequential head forming tools for mounting on a slide, an extrusion pointing tool for mounting on a die breast, a roll diameter extrusion tool for mounting on the die breast and a head support tool assembly mountable in a station on the slide for supporting a bolt head at a selected one of multiple predetermined axial positions corresponding to standard lengths of the bolts being made, the head support tool assembly being arranged to work at either the extrusion pointing station or the roll diameter extrusion station.

2. A set of tooling as set forth in claim 1, wherein the tools for making threaded to head style bolts include tools for use at a first of the four forming stations that upset the head.

3. A set of tooling as set forth in claim 1, wherein said extrusion pointing tool is arranged, when making partially threaded shank style bolts, to be axially shiftable between multiple positions corresponding to standard lengths of the bolts being made at a forming station on the die breast.

4. A set of tooling as set forth in claim 1, wherein said tools are arranged to form said pointed, headed bolts in at least two of three bolt styles comprising hex head, hex flange head, and socket head styles.

5. A method of reducing the number of tools necessary to produce pointed, headed preform bolts of a given diameter in numerous lengths with roll thread ready threaded to head and roll thread ready partially threaded shanks comprising the use of four progressive forming stations and a wire stock diameter greater than or about equal to a roll diameter and not greater than a nominal bolt diameter, when making roll thread ready threaded to head bolts, initially forming a head at a first station, and pointing a shank at a third or fourth station, and when making roll thread ready partially threaded bolts, shaping the head in at least a first and second station and extrusion pointing the shank and shaping the head at a station after the first station, and arranging a pointing tool in a selected one of multiple axial positions at a forming station on a die breast in accordance with a length of the bolt.

6. A method as set forth in claim 5, wherein when making threaded to head type bolts, the head is axially supported by an element having multiple selectable axial positions on a slide at the station in which the bolt is pointed.

7. A method as set forth in claim 5, wherein when making partially threaded shank bolts, the head is supported by an element having multiple selectable axial positions on a slide at the station in which the bolt shank is extruded to essentially a roll diameter.

* * * * *